US011873839B1

(12) United States Patent
Beers et al.

(10) Patent No.: US 11,873,839 B1
(45) Date of Patent: Jan. 16, 2024

(54) VARIABLE VANELESS DIFFUSER WITH MOVING FLOOR

(71) Applicant: Hamilton Sundstrand Corporation, Charlotte, NC (US)

(72) Inventors: Craig M. Beers, Wethersfield, CT (US); Brent J. Merritt, Southwick, MA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 17/942,942

(22) Filed: Sep. 12, 2022

(51) Int. Cl.
*F04D 29/46* (2006.01)

(52) U.S. Cl.
CPC ..... *F04D 29/464* (2013.01)

(58) Field of Classification Search
CPC ..... F04D 29/464
See application file for complete search history.

(56) References Cited

U.S. PATENT DOCUMENTS 2,996,996 A * 8/1961 Jassniker ..... F04D 15/0038 415/126
3,032,259 A * 5/1962 Jassniker ..... F04D 15/0022 415/148
3,826,586 A 7/1974 Richards
4,292,807 A * 10/1981 Rannenberg ..... F01D 17/143 60/601
4,460,310 A * 7/1984 Plunkett ..... F04D 27/0246 415/48
4,844,690 A 7/1989 Delaurier et al.
7,326,027 B1 2/2008 Skoch et al.
8,689,552 B2 * 4/2014 Iwata ..... F04D 29/462 415/48
9,212,667 B2 12/2015 Sun et al.
10,378,553 B2 8/2019 Sommer et al.
10,753,370 B2 8/2020 Hall et al.
11,125,247 B2 9/2021 Drolet
2011/0103938 A1 5/2011 Holroyd et al.
2011/0194929 A1 8/2011 Denholm et al.
2012/0251298 A1 10/2012 Moore et al.
2013/0064682 A1 3/2013 Sun et al.
2014/0328667 A1 * 11/2014 Sommer ..... F04D 27/0246 415/13
2017/0167292 A1 * 6/2017 Army ..... F01D 17/085
2021/0348622 A1 11/2021 Liu et al.

FOREIGN PATENT DOCUMENTS

JP 2014118925 A 6/2014

* cited by examiner

*Primary Examiner* — Brian O Peters
(74) *Attorney, Agent, or Firm* — Kinney & Lange, P.A.

(57) ABSTRACT

A variable vaneless diffuser includes a shroud, a backing plate, a divider plate adjacent to the backing plate, a floor plate adjacent to the shroud, a plurality of standoffs formed on the divider plate, and a plurality of clearance slots formed in the floor plate. The divider plate is between the shroud and the backing plate. The floor plate is between the shroud and the divider plate and is movable relative to the divider plate. The plurality of standoffs and the plurality of clearance slots define a flow path for fluid flow. The flow path has an area which is variable through movement of the floor plate relative to the divider plate.

20 Claims, 8 Drawing Sheets

VARIABLE VANELESS DIFFUSER WITH MOVING FLOOR

BACKGROUND

The present disclosure relates generally to aircraft environmental control systems and in particular to a vaneless, low-solidity diffuser with a moving floor and variable flow area.

Environmental control systems can provide conditioned air to an aircraft cabin. A cabin air compressor can be used to compress air for use in an environmental control system, and the cabin air compressor can include a variable diffuser. Many variable diffusers include a system of vanes which can vary the amount of airflow through the diffuser. However, vaned diffusers present a number of disadvantages. The vanes are constructed individually and then assembled, leading to high manufacturing costs and increased assembly time. Additionally, there are a large number of wear surfaces within the system due to the rotation of the vanes, which can decrease part life and increase maintenance costs.

SUMMARY

In one example, a variable vaneless diffuser includes a shroud, a backing plate, a divider plate adjacent to the backing plate, a floor plate adjacent to the shroud, a plurality of standoffs formed on the divider plate, and a plurality of clearance slots formed in the floor plate. The divider plate is between the shroud and the backing plate. The floor plate is between the shroud and the divider plate and is movable relative to the divider plate. The plurality of standoffs and the plurality of clearance slots define a flow path for fluid flow. The flow path has an area which is variable through movement of the floor plate relative to the divider plate.

In another example, a compressor includes a compressor housing, an impeller, and a variable vaneless diffuser downstream from the impeller. The compressor housing includes an inlet, an outlet, and a duct connecting the inlet to the outlet. The impeller is within the duct in the compressor housing. The variable vaneless diffuser is within the duct and includes a shroud, a backing plate, a divider plate adjacent to the backing plate, a floor plate adjacent to the shroud, a plurality of standoffs formed on the divider plate, and a plurality of clearance slots formed in the floor plate. The divider plate is between the shroud and the backing plate. The floor plate is between the shroud and the divider plate and is movable relative to the divider plate. The plurality of standoffs and the plurality of clearance slots define a flow path for fluid flow. The flow path has an area which is variable through movement of the floor plate relative to the divider plate.

DETAILED DESCRIPTION

A vaneless low-solidity diffuser can include a movable floor and a series of mating standoffs and clearance slots. The movable floor can be actuated to provide continuous motion over a range of flow areas. The use of standoffs/clearance slots with an actuated floor allows for the elimination of individual vanes, which are costly to produce and assemble, and reduces weight and part count of the diffuser system. Additionally, the low-solidity design (using standoffs which take up a low percentage of the surface area of the backing plate) allows for better performance across a wider range of operating conditions as compared to a channel diffuser.

Figure 1A:
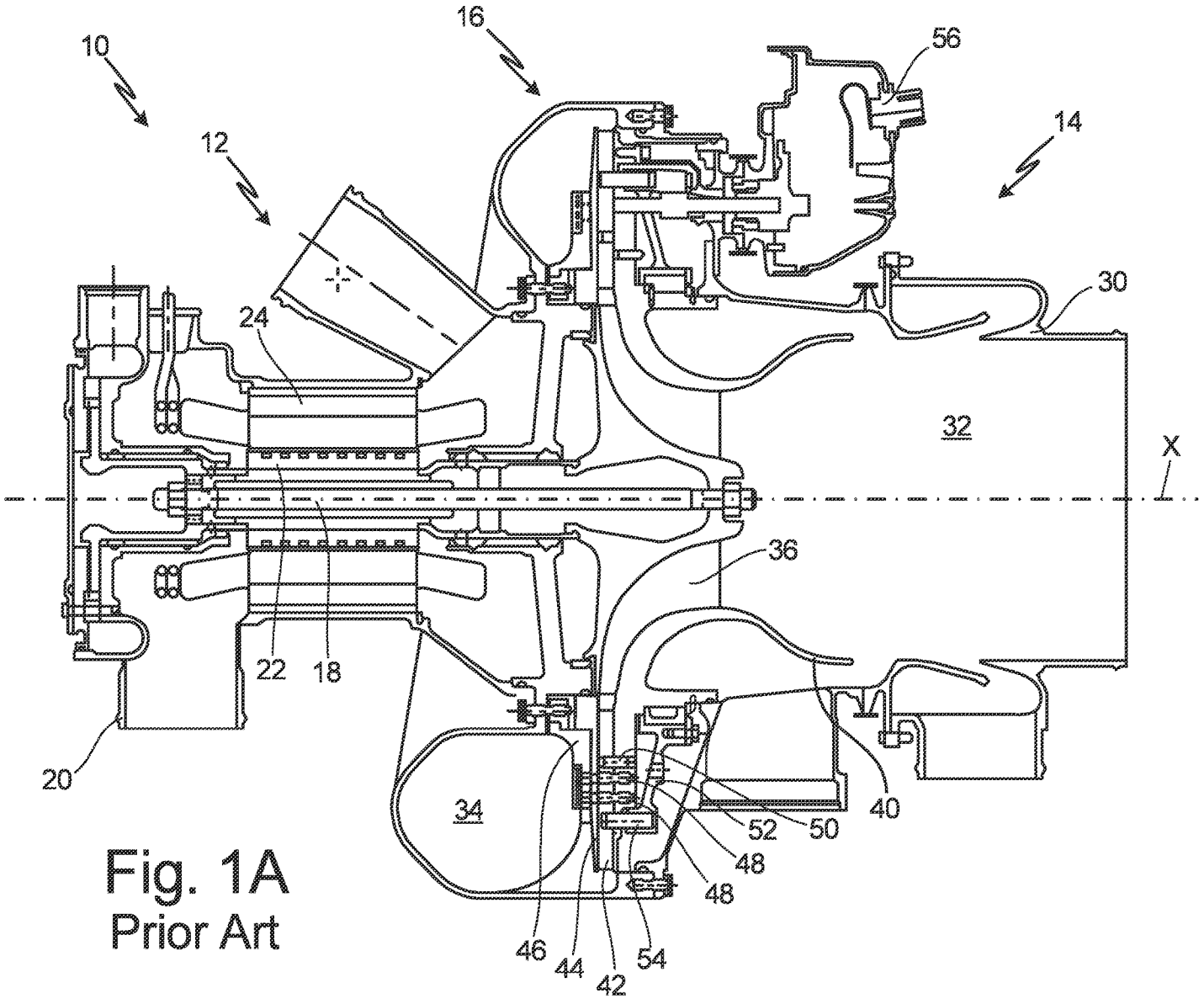
Fig. 1A Prior Art
FIGS. 1A-1B are cross-sectional views of a prior art air compressor.
Figure 1B:
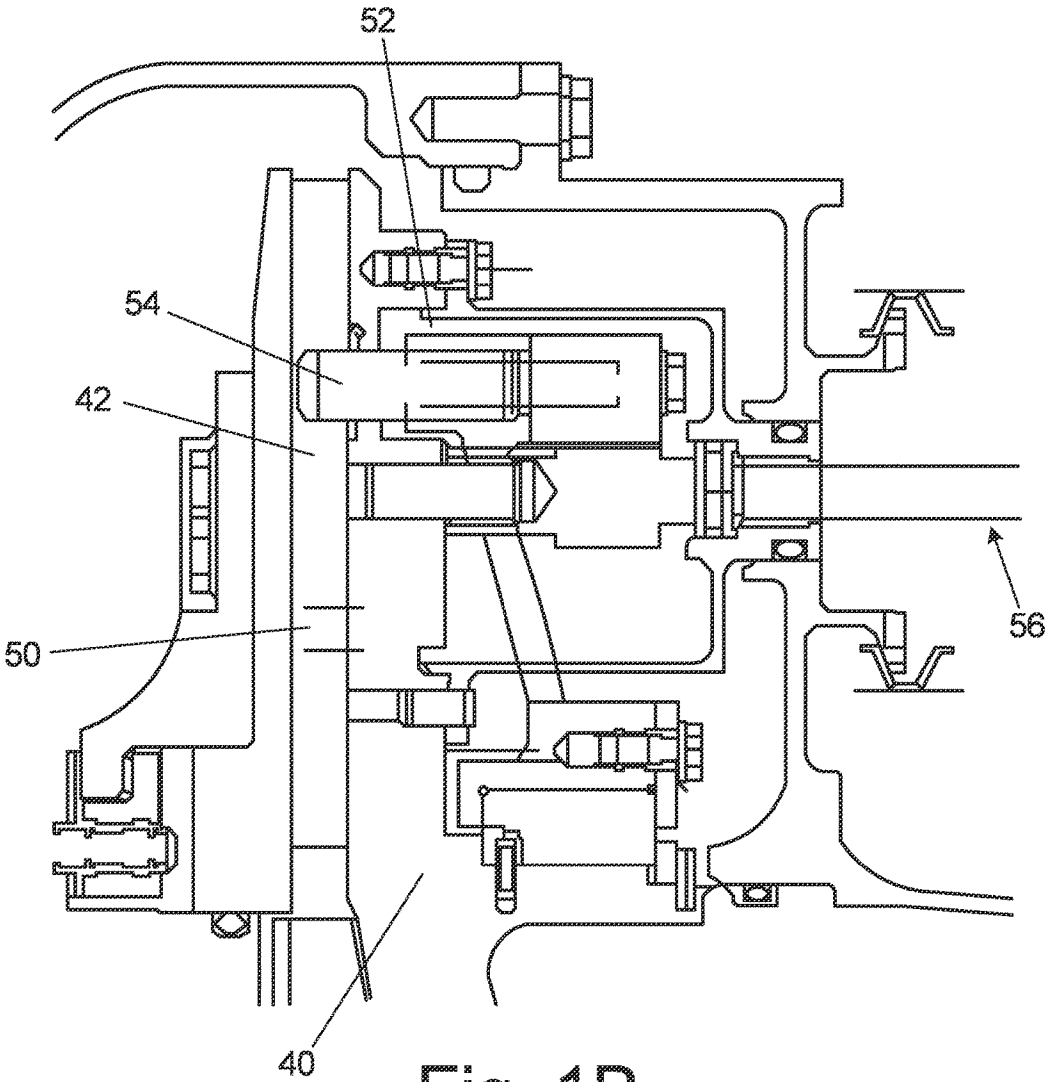
Fig. 1B Prior Art

FIG. 1A is a cross-sectional view of prior art air compressor 10. Prior art air compressor 10 includes motor 12, compressor section 14, prior art vaned diffuser 16, and tie rod 18. Also shown in FIG. 1A is axis X. Motor 12 drives compressor section 14 in prior art air compressor 10. Air will enter into compressor section 14 and then flow through prior art vaned diffuser 16 before exiting compressor section 14. Tie rod 18 extends through prior art air compressor 10 and is centered on axis X. Motor 12 and compressor section 14 are mounted to tie rod 18. Motor 12 will drive tie rod 18 and cause it to rotate, which in turn will rotate compressor section 14. FIG. 1B is a cross-sectional view of diffuser 16. FIGS. 1A-1B will be discussed together.

Motor 12 includes motor housing 20, motor rotor 22, and motor stator 24. Motor housing 20 surrounds motor rotor 22 and motor stator 24. Motor 12 is an electric motor with motor rotor 22 disposed within motor stator 24. Motor rotor 22 is rotatable about axis X. Motor rotor 12 is mounted to tie rod 18 to drive rotation of tie rod 18 in prior art air compressor 10.

Compressor section 14 includes compressor housing 30, compressor inlet 32, compressor outlet 34, and compressor rotor 36. Compressor housing 30 includes a duct that forms compressor inlet 32 and a duct that forms compressor outlet 34. Compressor inlet 32 draws air into compressor section 14. Positioned in compressor housing 30 is compressor rotor 36. Compressor rotor 36 is driven with motor 12 and is mounted on tie rod 18 to rotate with tie rod 18 about axis X. Air that is drawn into compressor section 14 through compressor inlet 32 is compressed with compressor rotor 36. The compressor air is then routed through prior art vaned diffuser 16 before exiting compressor section 14 through compressor outlet 34.

Prior art vaned diffuser 16 includes shroud 40, vanes 42, backing plate 44, mounting plate 46, fasteners 48, pivot pins 50, drive ring 52, drive pins 54, and diffuser actuator 56. Shroud 40 of prior art vaned diffuser 16 can be attached to compressor housing 30. Vanes 42 are positioned between shroud 40 and backing plate 44. Backing plate 44 is held against vanes 42 with mounting plate 46. Fasteners 48 extend through openings in mounting plate 46, backing plate 44, vanes 42, and shroud 40. Vanes 42 are positioned between shroud 40 and backing plate 44 so that there is a small clearance between vanes 42 and shroud 40 and between vanes 42 and backing plate 44.

Pivot pins 50 extend between openings in vanes 42 and openings in shroud 40. Vanes 42 can rotate about pivot pins 50. Drive ring 52 is positioned adjacent shroud 40. Drive pins 54 extend from drive ring 52 through shroud 40 into a slot in vanes 42. Drive ring 52 can be rotated about axis X with diffuser actuator 56. As drive ring 52 is rotated, drive pins 54 engaged in the slots in vanes 42 will drag vanes 42 and cause them to rotate about pivot pins 50. This movement of vanes 42 will vary the gap between adjacent vanes 42 to vary the amount of air flowing between vanes 42.

Varying the amount of air that flows between vanes 42 allows prior art vaned diffuser 16 to be used in different settings. First, when an aircraft is positioned on the ground the air that is taken into prior art vaned diffuser 16 is typically at a pressure that is suitable for use in the cabin. Vanes 42 can thus be positioned to allow air to flow through prior art vaned diffuser 16 without compressing the air. Alternatively, when an aircraft is in flight the air that is taken into prior art vaned diffuser 16 is typically at a low pressure that is unsuitable for use in the cabin. Vanes 42 can thus be positioned to compress the air flowing through prior art vaned diffuser 16 before that air is routed to an environmental control system.

Figure 2:
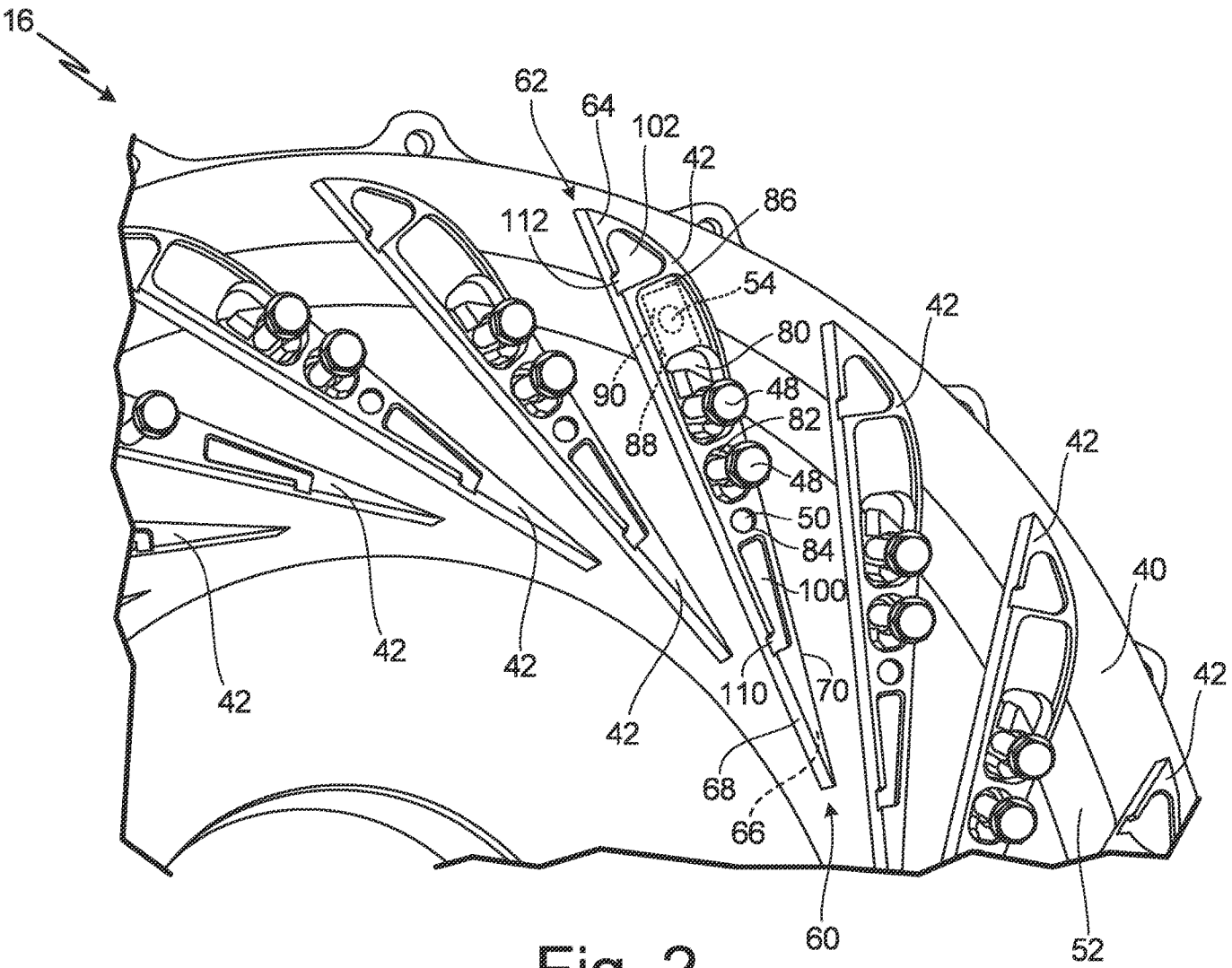
Fig. 2 Prior Art
FIG. 2 is a perspective cut-away view of a prior art variable diffuser.

FIG. 2 is a perspective cut-away view of prior art vaned diffuser 16. Prior art vaned diffuser 16 includes shroud 40, vanes 42, fasteners 48, pivot pins 50, drive ring 52, and drive pins 54. Each vane 42 includes inlet end 60, outlet end 62, first surface 64, second surface 66, leading surface 68, trailing surface 70, first aperture 80, second aperture 82, third aperture 84, first recess 86, second recess 88, slot 90, first cavity 100, second cavity 102, a third cavity (not shown in FIG. 2), a fourth cavity (not shown in FIG. 2), first notch 110, second notch 112, a third notch (not shown in FIG. 2), and a fourth notch (not shown in FIG. 2).

Prior art vaned diffuser 16 includes vanes 42 positioned on shroud 40. Fasteners 48 extend through a mounting plate (not shown in FIG. 2), a backing plate (not shown in FIG. 2), vanes 42, and shroud 40 to hold vanes 42 between the backing plate and shroud 40. Pivot pins 50 extend through vanes 42 and shroud 40 so that vanes 42 can pivot about pivot pins 50. Drive ring 52 is positioned adjacent shroud 40 and has a retaining ring that extends up to be flush with the surface of shroud 40 that abuts vanes 42. Drive pins 54 extend from drive ring 52 into vanes 42 to engage vanes 42. Drive ring 52 can be rotated, causing drive pins 54 to rotate vanes 42.

Vanes 42 are pivotally positioned in prior art vaned diffuser 16. Each vane 42 includes inlet end 60 positioned radially inward in relation to prior art vaned diffuser 16 and outlet end 62 positioned radially outward in relation to prior art vaned diffuser 16. Each vane 42 also includes first surface 64 and second surface 66 extending from inlet end 60 to outlet end 62. First surface 64 abuts the backing plate (not shown in FIG. 2) and second surface 64 abuts shroud 40. Each vane 42 also includes leading surface 68 and trailing surface 70 extending from inlet end 60 to outlet end 62. Leading surface 68 faces radially inward in relation to prior art vaned diffuser 16 and trailing surface 70 faces radially outward in relation to prior art vaned diffuser 16.

Each vane 42 includes first aperture 80 and second aperture 82 extending from first surface 64 to second surface 66. First aperture 80 receives one fastener 48 and second aperture 82 receives one fastener 48. First aperture 80 and second aperture 82 are sized so that first aperture and second aperture 82 do not limit the movement of vane 42 when it pivots. There is a small clearance between vanes 42 and shroud 40 and between vanes 42 and the backing plate.

Each vane 42 also includes third aperture 84 extending from first surface 64 to second surface 66. Third aperture 84 is sized to receive pivot pin 50. Vanes 42 pivot on pivot pins Each vane 42 further includes first recess 86, second recess 88, and slot 90. First recess 86 is positioned on first surface 64 of vane 42. Second recess 88 is positioned on second surface 66 of vane 42. Second recess 88 is positioned around slot 90. Slot 90 extends a distance into vane 42 from second surface 66. Slot 90 is sized to slidably engage drive pin 54. As drive ring 52 rotates, drive pins 54 can slide through slots 90 to rotate vanes 42 about pivot pins 50.

Each vane 42 further includes first cavity 100, second cavity 102, a third cavity, and a fourth cavity. First cavity 100 and second cavity 102 are positioned on first surface 64. The third cavity and fourth cavity are positioned on second surface 66. The third cavity and fourth cavity are not shown in FIG. 2, as the third cavity is positioned below first cavity 100 on second surface 66 facing shroud 40 and the fourth cavity is positioned below second cavity 102 on second surface 66 facing shroud 40. Vane 42 further includes first notch 110, second notch 112, a third notch, and a fourth notch. First notch 110 in on first surface 64 and extends from leading surface 68 to first cavity 100. Second notch 112 is on first surface 64 and extends from leading surface 68 to second cavity 102. The third notch is on second surface 66 and extends from trailing surface 70 to the third cavity. The fourth notch is on second surface 66 and extends from trailing surface 70 to the fourth cavity. The third notch and fourth notch are not shown in FIG. 2, as they are positioned on second surface 66 facing shroud 40.

First cavity 100, second cavity 102, the third cavity, and the fourth cavity are included on vane 42 to load vane 42 against the backing plate (not shown in FIG. 2). First notch 110, second notch 112, the third notch, and the fourth notch are included on vane 42 to vent first cavity 100, second cavity 102, the third cavity, and the fourth cavity, respectively. This allows air that is flowing through prior art vaned diffuser 16 to flow into first cavity 100, second cavity 102, the third cavity, and the fourth cavity through first notch 110, second notch 112, the third notch, and the fourth notch, respectively. First cavity 100, second cavity 102, the third cavity, and the fourth cavity are vented to different pressures to create the load that holds vane 42 against the backing plate.

Figure 3B:
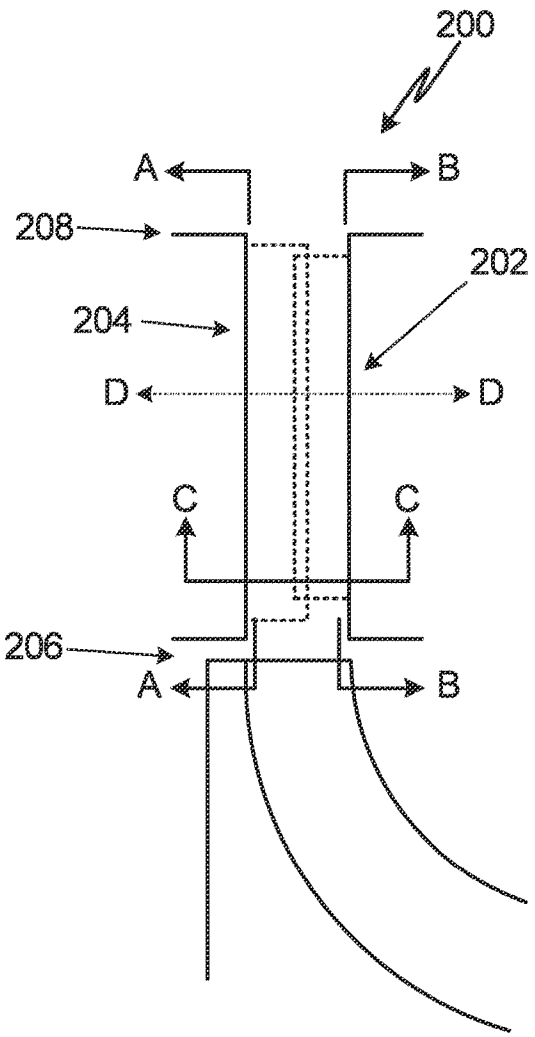
FIG. 3B is a schematic depiction of the variable vaneless diffuser of FIG. 3A in an extended state.
Figure 3A:
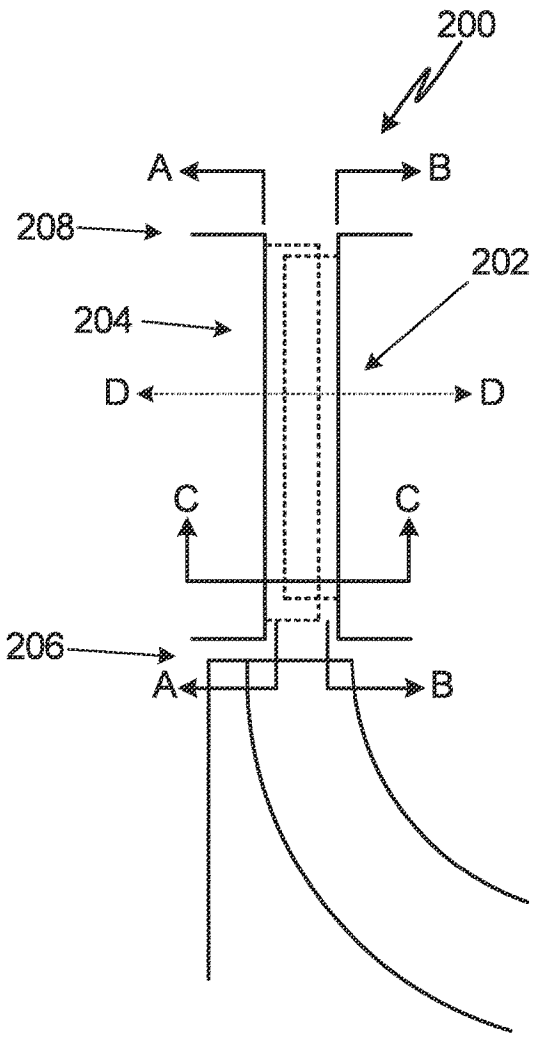
FIG. 3A is a schematic depiction of a variable vaneless diffuser in a compressed state.

FIG. 3A is a schematic depiction of variable vaneless diffuser 200 in a fully compressed state. Variable vaneless diffuser 200 includes a shroud (such as shroud 40 shown in FIGS. 1A and 2, or shroud 216 shown in FIGS. 6A-6B; not shown in FIGS. 3A-3B), a backing plate (such as backing plate 44 shown in FIGS. 1A-2; not shown in FIGS. 3A-3B), floor plate 202, divider plate 204, diffuser inlet section 206, and diffuser outlet section 208. Floor plate 202 includes standoffs 210 (shown in FIGS. 4B and 5A-5B), and divider plate 204 includes clearance slots 212 (shown in FIGS. 4A and 5A-5B). FIG. 3B is a schematic depiction of variable vaneless diffuser 200 in a fully expanded state. FIGS. 3A-3B will be discussed concurrently.

Floor plate 202 is located adjacent to the shroud such that floor plate 202 is on a shroud side of variable vaneless diffuser 200. Divider plate 204 is located adjacent to the backing plate such that divider plate 204 is on a backing plate side of variable vaneless diffuser 200. Diffuser outlet section 208 is located radially outward of diffuser inlet section 206 with respect to an axis (such as axis X shown in FIG. 1A).

As described in more detail below in reference to FIGS. 6A-6B, floor plate 202 can be slidably connected to the shroud. This slidable connection allows floor plate 202 to move along line D-D relative to divider plate 204 such that floor plate 202 can move closer to, or further from, divider plate 204. For example, variable vaneless diffuser 200 can be in the fully compressed state shown in FIG. 3A when floor plate 202 is at a minimum distance from divider plate 204, and can be in the fully extended state shown in FIG. 3B when floor plate 202 is at a maximum distance from divider plate 204. The movement of floor plate 202 can be driven by servo pressure (which can be provided from a post-heat exchanger hose or a compressor outlet), and additionally or alternatively can be driven by an actuator (such as actuator 218 shown in FIG. 6A). The delivered servo pressure can reduce the load on the actuator, which can increase the life of the actuator.

Variable vaneless diffuser 200 operates in a similar manner as prior art vaned diffuser 16 (described above in reference to FIGS. 1A-2). Variable vaneless diffuser 200 receives airflow at diffuser inlet section 206 from a compressor inlet (such as compressor inlet 32 shown in FIG. 1A) after the airflow has passed through an impeller (such as compressor rotor 36 shown in FIG. 1A). Variable vaneless diffuser 200 can thus be downstream of the impeller with respect to the direction of airflow through the compressor. The airflow is then diffused as it travels through variable vaneless diffuser 200 from diffuser inlet section 206 to diffuser outlet section 208 through flow path 214 (shown in FIGS. 5A-5B).

As described in more detail below in reference to FIGS. 4A-5B, divider plate 204 includes standoffs 210 which each mate with a clearance slot 212 formed in floor plate 202. The standoffs 210 and clearance slots 212 define a flow path 214 (shown in FIGS. 5A-5B) which has a flow area that is variable based on the movement of floor plate 202 relative to divider plate 204.

Figure 4A:
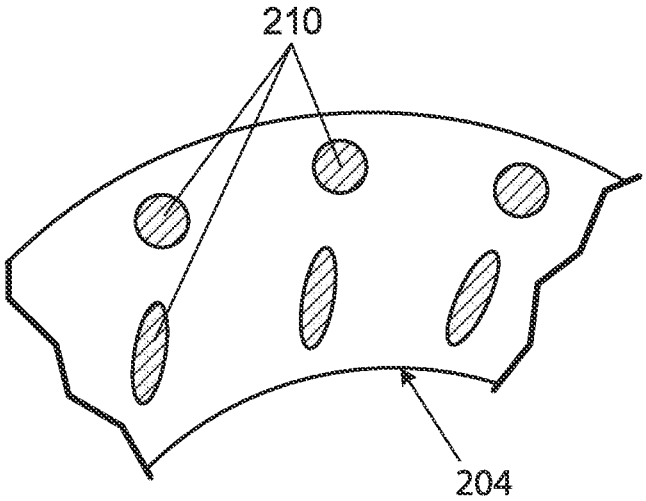
FIGS. 4A-4B are schematic depictions mating standoffs and clearance slots within the variable vaneless diffuser of FIG. 3A.
Figure 4B:
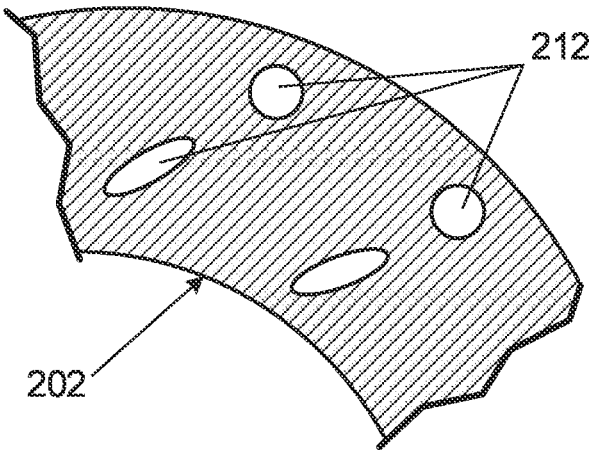

FIG. 4A is a schematic depiction of divider plate 204 viewed along line A-A of FIGS. 3A-3B. Divider plate 204 includes standoffs 210. FIG. 4B is a schematic depiction of floor plate 202 viewed along line B-B of FIGS. 3A-3B. Floor plate 202 includes clearance slots 212. FIGS. 4A-4B will be discussed concurrently.

As described above in reference to FIGS. 3A-3B, floor plate 202 is located adjacent to the shroud (that is, on the shroud side of variable vaneless diffuser 200) and divider plate 204 is located adjacent to the backing plate (on the backing plate side of variable vaneless diffuser 200). Standoffs 210 are formed on divider plate 204 such that standoffs 210 form raised shapes which extend away from divider plate 204. In some examples, standoffs 210 can be approximate ellipses in shape. Clearance slots 212 are formed in floor plate 202 such that clearance slots 212 form sunken shapes which extend into floor plate 202. Clearance slots 212 have a shape which approximates the shape of each standoff 210 such that each standoff 210 is able to fit into a clearance slot 212. In examples where standoffs 210 are approximately elliptical, clearance slots 212 can be recesses which are also approximately elliptical in shape. The number of standoffs 210 is equal to the number of clearance slots 212 such that each standoff 210 has a corresponding clearance slot 212. In some examples, standoffs 210 can be arranged circumferentially about floor plate 202 and be approximately evenly spaced. In some examples, clearance slots 212 can be similarly arranged circumferentially about divider plate 204 and be approximately evenly spaced.

As described above in reference to FIGS. 3A-3B, floor plate 202 can be movable along line D-D (shown in FIGS. 3A-3B) relative to divider plate 204. The circumference of each clearance slot 212 is slightly larger than the circumference of each standoff 210. During operation of variable vaneless diffuser 200, this provides a close clearance between each standoff 210 and each clearance slot 212 as opposed to a tight fit. This close clearance can increase the life of components within variable vaneless diffuser 200 by reducing the number of wear surfaces.

As described above in reference to FIGS. 3A-3B, the axial movement of floor plate 202 relative to divider plate 204 causes the movement of each standoff 210 relative to a clearance slot 212. The movement of each standoff 210 with respect to the corresponding clearance slot 212 allows for the flow of air through flow path 214 to be varied as the flow area of flow path 214 changes. Standoffs 210 serve as flow straighteners within variable vaneless diffuser 200.

Standoffs 210 can be integrally formed with floor plate 202, and floor plate 202 can be manufactured as a single piece through casting or additive manufacturing techniques. Similarly, clearance slots 212 can be formed in divider plate 204 through casting or additive manufacturing, machining, or a combination of these techniques.

The low-solidity design of variable vaneless diffuser 200, in combination with the flow-straightening provided by standoffs 210, provides increased efficiency over a channel diffuser over a wider range of operating conditions. For example, while variable vaneless diffuser 200 may be slightly less efficient at the flow rate at which a channel diffuser achieves optimal performance, variable vaneless diffuser 200 can achieve better performance at lower and higher flow rates. This increased efficiency range is desirable for accommodating a more diverse set of operating conditions.

Figure 5A:
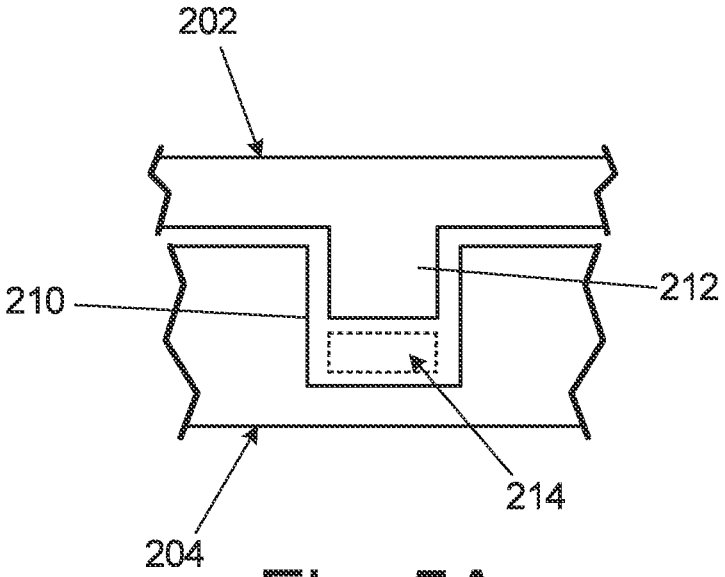
FIG. 5A is a schematic cross-sectional view of a mating air passage and standoff within the variable vaneless diffuser of FIG. 3A in a compressed state.
Figure 5B:
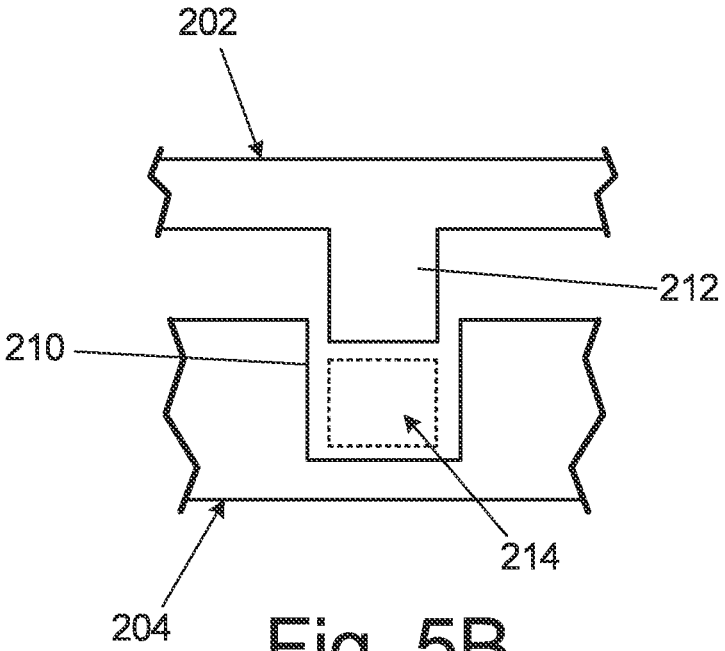
FIG. 5B is a schematic cross-sectional view of the mating standoff and clearance slot of FIG. 5A in an expanded state.

FIGS. 5A-5B are schematic cross-sectional views of a section of variable vaneless diffuser 200 along line C-C of FIGS. 3A-3B. Shown in FIG. 5A are a mating clearance slot 212 and standoff 210, which define a portion of flow path 214, when variable vaneless diffuser 200 is in a fully compressed state. Shown in FIG. 5B are the mating clearance slot 212 and standoff 210 when variable vaneless diffuser 200 is in a fully expanded state. FIGS. 5A-5B will be discussed in turn below.

As described above in reference to FIGS. 4A-4B, standoffs 210 mate with clearance slots 212 to form flow path 214, and the movement of standoff 210 relative to clearance slot 212 is driven by the movement of floor plate 202 relative to divider plate 204. The flow area of flow path 214 is variable based upon the position of standoffs 210 relative to clearance slots 212. Flow path 214 includes a flow path inlet in diffuser inlet section 206 and a flow path outlet in diffuser outlet section 208 (both shown in FIGS. 3A-3B).

When variable vaneless diffuser 200 is in a fully compressed state, as in FIG. 5A, flow path 214 has a minimum flow area. When variable vaneless diffuser 200 is in a fully expanded state, as in FIG. 5A, flow path 214 has a maximum flow area. The flow area of flow path 214 can be varied based upon the pressure and speed of air which is entering variable vaneless diffuser 200.

Figure 6A:
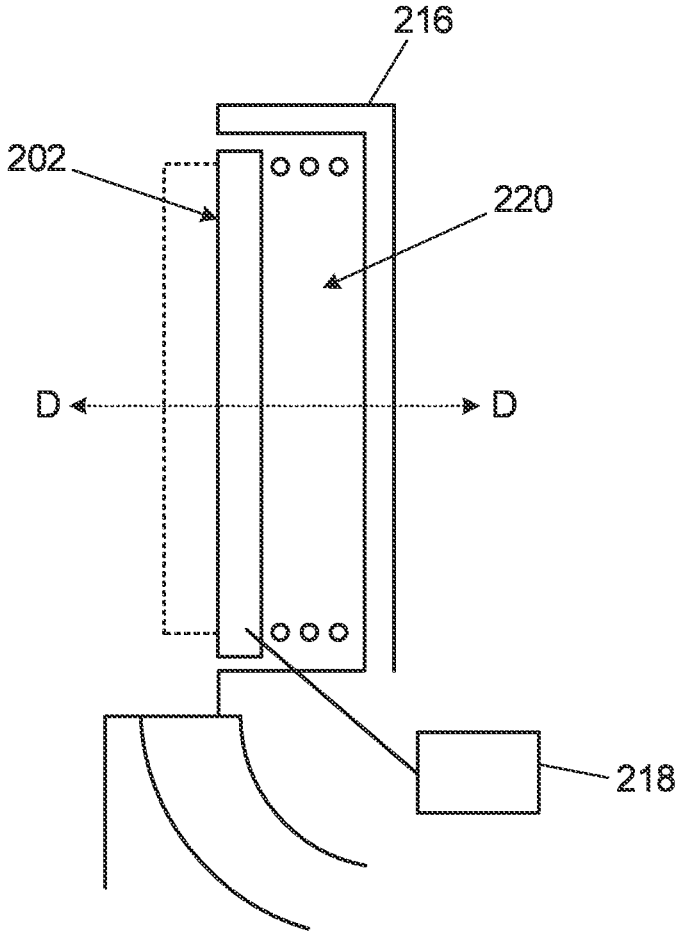
FIG. 6A is a schematic depiction of the variable vaneless diffuser of FIG. 3A including a sliding mechanism.
Figure 6B:
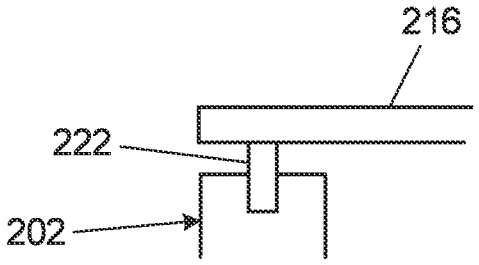
FIG. 6B is a schematic depiction of the sliding mechanism of FIG. 6A.

FIG. 6A is a schematic depiction of the shroud side of variable vaneless diffuser 200 which includes shroud 216, floor plate 202, and actuator 218. Shroud 216 and floor plate 202 define floor cavity 220. FIG. 6B is a schematic depiction of slider seal 222 which connects shroud 216 and floor plate 202. FIGS. 6A-6B will be discussed concurrently.

Shroud 216 can operate in substantially the same manner as shroud 40 (described above in reference to FIGS. 1A-2). As described above in reference to FIGS. 3A-3B, floor plate 202 is slidably connected to shroud 216 such that floor plate 202 is movable relative to divider plate 204 (shown in FIGS. 3A-3B) along line D—D. Floor plate 202 can be slidably connected to shroud 216 via a sliding mechanism. This sliding mechanism can be, for example a seal ring such as slider seal 222. The sliding mechanism can additionally or alternatively be a metallic seal, a non-metallic seal, or a slipper seal.

Servo pressure can be supplied to floor cavity 220 from a servo pressure source, such as a heat exchanger outlet or a compressor outlet (such as compressor outlet 34 shown in FIG. 1A). Ambient pressure, in addition to the added pressure from the compressor outlet, can be less than the pressure within flow path 214. This enables the movement of floor plate 202 away from divider plate 204 by allowing the flow path area to increase. In some examples, actuator 218 can be used to drive the movement of floor plate 202 relative to shroud 216 and divider plate 204. Actuator 218 can supplement servo pressure provided to floor cavity 220. In some examples (such as the example shown in FIG. 7), actuator 218 can be a torque motor. In other examples, actuator 218 can be a linear actuator.

Figure 7:
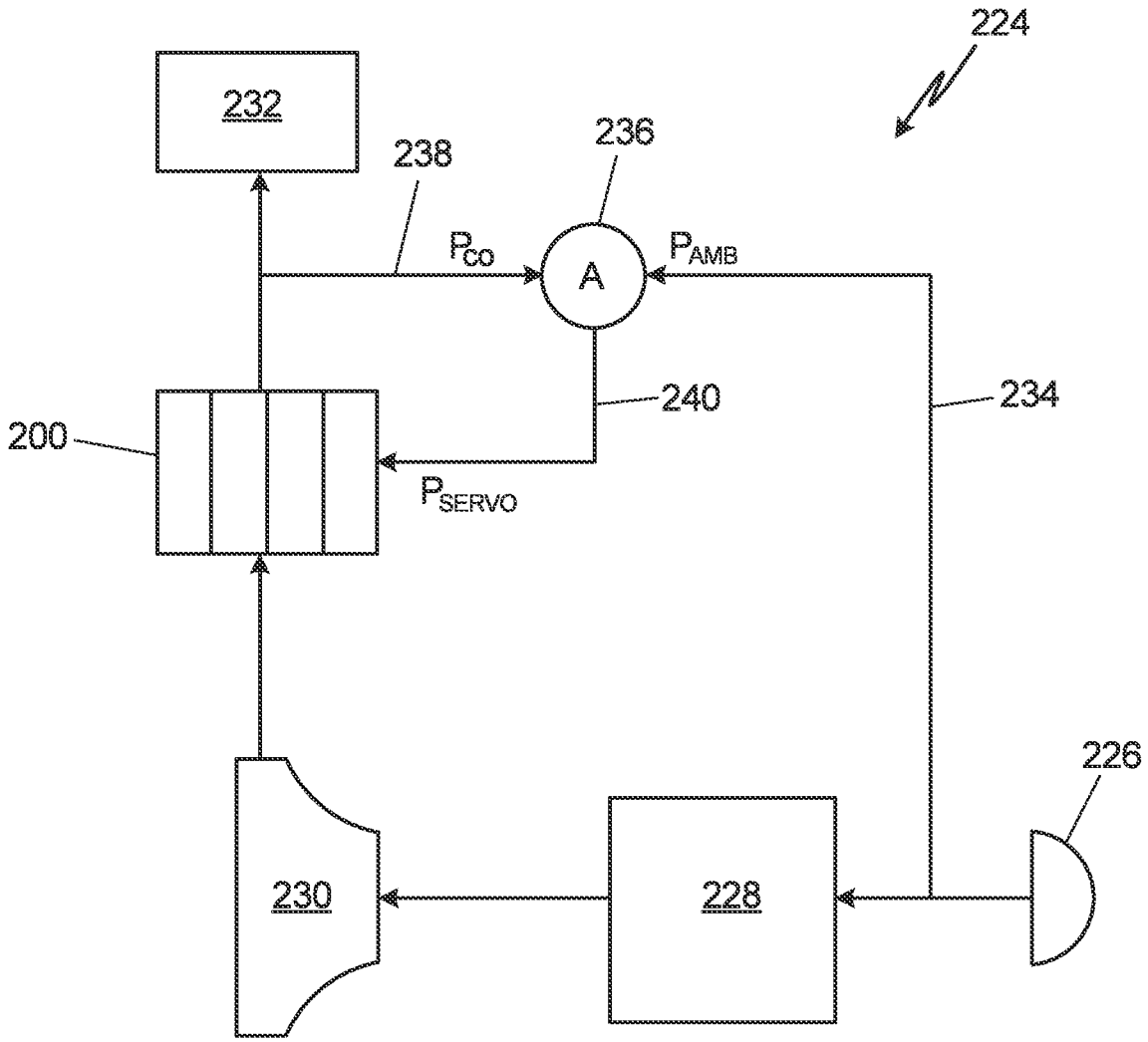
FIG. 7 is a schematic depiction of an air compressor including the variable vaneless diffuser of FIG. 3A.

FIG. 7 is a schematic depiction of air compressor 224 including variable channel diffuser 200. Air compressor 224 includes ram air scoop 226, compressor housing inlet 228, impeller 230, variable channel diffuser 200, and compressor housing outlet 232. Air compressor 224 also includes a servo pressure system with ambient pressure air duct 234, torque motor 236, compressed pressure air duct 238, and servo pressure air duct 240.

Ram air scoop 226 is located along a body of an aircraft and ducts ambient air into air compressor 224. Air compressor 224 includes a compressor housing, and compressor housing inlet 228, impeller 230, variable diffuser 200, and compressor housing outlet 232 are all located within the compressor housing. Air compressor 224 operates similarly to compressor 10 (shown in FIG. 1A). Compressor housing inlet 228 receives air from ram air scoop 226 and moves air toward impeller 230. Air then moves through impeller 230 where velocity increases. Impeller 230 is upstream from variable diffuser 200. Air moves from impeller 230 into open channels in variable channel diffuser 200. Within variable diffuser 200, air loses velocity and increases in pressure. Compressed air moves out of variable channel diffuser 200 toward compressor housing outlet 232.

In the example shown in FIG. 7, compressor 224 includes a servo pressure system to adjust the area of flow path 214 within variable channel diffuser 200 using servo pressure. Ambient pressure air duct 234 connects ram air scoop 226 with torque motor 236. Ambient pressure air duct 234 can receive ambient air from the external environment of the aircraft (i.e., through ram air scoop 226) and/or receive air from a compressor inlet. Compressed pressure air duct 238 connects a portion of the compressor housing downstream from variable diffuser 200 with torque motor 236. Additionally or alternatively, compressed pressure air duct 238 can use air from a heat exchanger downstream of air compressor 224. Servo pressure air duct 240 connects torque motor 236 to variable channel diffuser 200. Torque motor 236 can combine air at an ambient pressure ($P_{AMB}$) with air at a compressed pressure ($P_{CO}$). Ambient pressure is dependent on the altitude of the aircraft. Compressed pressure is dependent on the area of flow path 214 within variable channel diffuser 200. Torque motor 236 can generate a flow of air at a servo pressure ($P_{SERVO}$) by, for example, mixing ambient pressure air and compressed pressure air. Servo pressure air duct 240 moves air at servo pressure ($P_{SERVO}$). Servo pressure air duct 240 can connect to a cavity (such as cavity 220 shown in FIG. 6A). When servo pressure is higher than pressure within the compressor housing between torque motor 236 and variable diffuser 200, servo pressure can drive floor plate 202 to move between various positions (for example, between the fully compressed state shown in FIG. 5A and the fully extended state shown in FIG. 5B). Servo pressure can be used in combination with, or in place of, an actuator such as torque motor 236 to help reduce the load on the actuator, thus increasing actuator lifespan.

A variable vaneless diffuser as described herein provides numerous advantages. The number of wear surfaces are greatly reduced as compared to a diffuser including vanes. Time and costs relating to manufacturing, assembly, and maintenance can be reduced due to a lower number of parts. A low-solidity design provides increased efficiency over a greater range of operating conditions than a channel diffuser, and decreases the impact of flow leakage on diffuser performance. Finally, the use of a variable vaneless diffuser can decrease system weight as compared to conventional vaned diffusers.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A variable vaneless diffuser comprising:

a shroud;

a backing plate;

a divider plate adjacent to the backing plate such that the divider plate is between the shroud and the backing plate;

a floor plate adjacent to the shroud such that the floor plate is between the shroud and the divider plate, wherein the floor plate is movable relative to the divider plate;

a floor cavity defined by the floor plate and the shroud, wherein air at servo pressure is supplied to the floor cavity to move the floor plate relative to the divider plate, and wherein the air at servo pressure is a mixture of ambient pressure air and compressed pressure air mixed by a servo pressure source upstream from the floor cavity;

a plurality of standoffs formed on the divider plate; and a plurality of clearance slots formed in the floor plate, wherein the plurality of standoffs and the plurality of clearance slots define a flow path for fluid flow, the flow path having an area which is variable through movement of the floor plate relative to the divider plate.

2. The variable vaneless diffuser of claim 1, wherein the floor plate is slidably connected to the shroud.

3. The variable vaneless diffuser of claim 2, wherein the floor plate is slidably connected to the shroud via a slider seal.

4. The variable vaneless diffuser of claim 2, wherein the floor plate has a continuous range of motion such that the area of the flow path is continuously variable between a minimum flow area and a maximum flow area.

5. The variable vaneless diffuser of claim 1, further comprising an actuator which drives movement of the floor plate relative to the divider plate.

6. The variable vaneless diffuser of claim 5, wherein the actuator is a torque motor upstream from the floor cavity, wherein the torque motor is the servo pressure source, and wherein the torque motor mixes the ambient pressure air and the compressed pressure air to generate the air at servo pressure.

7. The variable vaneless diffuser of claim 1, wherein each standoff has an approximate elliptical shape and each clearance slot has an approximate elliptical shape which mates to the approximate elliptical shape of the standoff.

8. The variable vaneless diffuser of claim 1, wherein the plurality of standoffs is arranged circumferentially about the divider plate and the plurality of clearance slots is arranged circumferentially about the floor plate.

9. A compressor comprising:

a compressor housing comprising:

an inlet;

an outlet; and a duct connecting the inlet to the outlet;

an impeller within the duct in the compressor housing; and a variable vaneless diffuser within the duct and downstream from the impeller, the variable vaneless diffuser comprising:

a shroud;

a backing plate;

a divider plate adjacent to the backing plate such that the divider plate is between the shroud and the backing plate;

a floor plate adjacent to the shroud such that the floor plate is between the shroud and the divider plate, wherein the floor plate is movable relative to the divider plate;

a floor cavity defined by the floor plate and the shroud, wherein air at servo pressure is supplied to the floor cavity to move the floor plate relative to the divider plate, and wherein the air at servo pressure is a mixture of ambient pressure air and compressed pressure air mixed by a servo pressure source upstream from the floor cavity;

a plurality of standoffs formed on the divider plate; and a plurality of clearance slots formed in the floor plate, wherein the plurality of standoffs and the plurality of clearance slots define a flow path for fluid flow, the flow path having an area which is variable through movement of the floor plate relative to the divider plate.

10. The compressor of claim 9, wherein the outlet of the compressor housing supplies the compressed pressure air.

11. The compressor of claim 9, wherein the floor plate is slidably connected to the shroud.

12. The compressor of claim 11, wherein the floor plate is slidably connected to the shroud via a slider seal.

13. The compressor of claim 11, wherein the floor plate has a continuous range of motion such that the area of the flow path is continuously variable between a minimum flow area and a maximum flow area.

14. The compressor of claim 9, further comprising an actuator which drives movement of the floor plate relative to the divider plate.

15. The compressor of claim 14, wherein the actuator is a torque motor upstream from the floor cavity, wherein the torque motor is the servo pressure source, and wherein the torque motor mixes the ambient pressure air and the compressed pressure air to generate the air at servo pressure.

16. The compressor of claim 9, wherein each standoff has an approximate elliptical shape and each clearance slot has an approximate elliptical shape which mates to the approximate elliptical shape of the standoff.

17. The compressor of claim 9, wherein the plurality of standoffs is arranged circumferentially about the floor plate and the plurality of recessed areas is arranged circumferentially about the divider plate.

18. The variable vaneless diffuser of claim 5, wherein the actuator is a linear actuator.

19. The compressor of claim 14, wherein the actuator is a linear actuator.

20. The compressor of claim 9, wherein the inlet of the compressor housing supplies the ambient pressure air.

* * * * *